US005189479A

United States Patent [19]

Matsuda et al.

[11] Patent Number: 5,189,479

[45] Date of Patent: Feb. 23, 1993

[54] IMAGE TRANSFERRING DEVICE FOR A COLOR IMAGE RECORDER

[75] Inventors: Itaru Matsuda; Hiroyuki Ohkaji, both of Yokohama, Japan

[73] Assignee: Ricoh Company, Ltd., Tokyo, Japan

[21] Appl. No.: 723,437

[22] Filed: Jun. 28, 1991

[30] Foreign Application Priority Data

Jun. 29, 1990 [JP] Japan ..... 2-174159
Jun. 29, 1990 [JP] Japan ..... 2-174160
Jan. 25, 1991 [JP] Japan ..... 3-007873

[51] Int. Cl.[5] ..... G03G 15/16

[52] U.S. Cl. ..... 355/274; 355/271; 355/327

[58] Field of Search ..... 355/326, 327, 272, 273, 355/274

[56] References Cited

U.S. PATENT DOCUMENTS 4,615,607 10/1986 Yanagawa et al. .
4,664,501 5/1987 Koizumi et al. .
4,887,101 12/1989 Hirose et al. ..... 355/327 X
4,893,179 1/1990 Ito ..... 355/327 X
4,937,664 6/1990 Chiku et al. ..... 355/327 X
4,984,024 1/1991 Ohkaji et al. ..... 355/273
5,041,877 8/1991 Matsumoto ..... 355/271

FOREIGN PATENT DOCUMENTS 59-155871 9/1984 Japan .

OTHER PUBLICATIONS

Patent Abstracts of Japan, vol. 14, No. 160, P-1056, Jun. 5, 1990, "Transfer Pre-Processor", Abstract of Kokai 2-69790.

*Primary Examiner*—Richard L. Moses
*Attorney, Agent, or Firm*—Oblon, Spivak, McClelland, Maier & Neustadt

[57] ABSTRACT

An image transferring device incorporated in a color image recorder has a belt made of a dielectric material and movable while sequentially contacting a plurality of photoconductive elements at successive image transfer positions. Toner images formed on the photoconductive elements are sequentially transferred to the belt or a recording medium one above another by transfer chargers. Conductive members are located to face opposite surfaces of the belt and fully spaced apart from the latter by a predetermined distance, and each has an insulating member on the surface thereof that faces the belt. The conductive members are located between a position immediately succeeding the image transfer position on the most upstreamside and the position where the recording medium leaves the belt. A belt pressing member and a transfer charge limiting member are disposed in a position immediately preceding any one of the image transfer positions with respect to an intended direction of movement of the belt. The belt pressing member urges the belt against associated one of the photoconductive elements. The transfer charge limiting member prevents the charge from associated one of the transfer charges from reaching the zone upstream of the above-mentioned immediately preceding position.

7 Claims, 9 Drawing Sheets

IMAGE TRANSFERRING DEVICE FOR A COLOR IMAGE RECORDER

BACKGROUND OF THE INVENTION

The present invention relates to an electrophotographic color image recorder and, more particularly, to an image transferring device incorporated in such a recorder for transferring toner images to a recording medium one above another.

A digital color copier, for example, belongs to a family of electrophotographic color image recorders extensively used today. A digital color copier has an image reading section and an image forming section. In the image reading section, optics illuminates a document and then optically separates it into red, blue and green components. These color components each is converted into a digital signal by a particular CCD (Charge Coupled Device) array. The digital signals from the CCD arrays are processed and then applied to semiconductor lasers corresponding one-to-one to the CCD arrays as image data. In the image forming section, laser beams issuing from the lasers are incident to photoconductive elements each being assigned to a particular color component, thereby electrostatically forming latent images on the photoconductive elements. Developing units each storing respective one of a yellow toner, magenta toner, cyan toner and black toner develop the latent images by the toners. A belt carrying a recording medium in the form of paper sheet thereon sequentially transports the paper sheet to successive image transfer positions defined below the photoconductive elements. The toner images of different colors are sequentially transferred from the photoconductive elements to the paper sheet one above another by transfer chargers. The resulted composite color image formed on the paper sheet is fixed by a fixing unit. Then, the paper sheet carrying the fixed color image thereon is driven out onto a tray.

As stated above, the belt and transfer chargers incorporated in the color copier constitute an image transferring device. It has been customary to use backup members which urge the belt against the photoconductive elements from the rear of the belt in order to enhance the close contact of the paper sheet and the photoconductive elements. Usually, the backup members are implemented as metallic rollers which contact the rear of the belt and support the belt while being rotated by the latter. However, the problem is that as the belt made of a dielectric substance and charged by the transfer chargers are abruptly brought into and out of contact with the metallic rollers, undesired electric fields are developed therebetween. Such undesired electric fields disturb the desired electric fields developed between the transfer chargers and the photoconductive elements. In addition, when the belt leaves any one of the rollers, the potential therebetween increases to cause a separation discharge to occur with the result that the charge on the rear of the belt is neutralized, loosing the force for retaining the toner. Consequently, the toner images to be transferred to the paper sheet are disturbed. Regarding the disturbance to the images, a reference will be made to Japanese Patent Laid-Open Publication Nos. 33072/1980 and 97357/1981.

In light of the above, a plurality of pairs of field stabilizing plates may be arranged along opposite surfaces of the belt at positions other than the positions where the photoinductive elements face the associated transfer chargers with the intermediary of the belt, i.e., at positions between nearby photoconductive elements and between nearby transfer chargers. Each of the filed stabilizing plates intervening between the transfer chargers, i.e., located at the rear of the belt has a lug at the center thereof which abuts against the rear of the belt. Such field stabilizing plate pairs eliminate undesired electric fields and prevent the potentials from increasing, thereby freeing images from disturbance. However, the corona discharge effected by the transfer chargers produce nitrogen oxides, while the belt and a drive roller driving the belt produce low-resistance impurities such as carbon of the drive roller since they slide on each other. As such impurities deposit between the belt and the backup lugs, the electric fields fluctuate in the vicinity of the belt to cause discharges to occur, disturbing the toner image. Furthermore, when the belt is supported by the backup lugs, the pressure urging the belt, i.e., the paper sheet against any one of the photoconductive elements is not always optimal and, moreover, susceptible to ambient conditions. If this pressure is low, the toner image will not be satisfactorily transferred and, therefore, the image density on the paper sheet will be low. Conversely, excessively high pressures would cause thin lines and the edges of solid images each having a substantial width, especially the portions thereby where a great amount of toner deposits, to be lost inside. While a toner with an additive which enhances fluidity may be used to eliminate such an occurrence, the amount of additive should be limited in consideration of the filming to occur on the photoconductive elements and the change in ambient conditions.

An implementation for using a paper sheet against the photoconductive elements by an adequate pressure is disclosed in Japanese Patent Laid-Open Publication No. 127770/1987 by way of example. This implementation uses a presser member in the form of a thin elastic plate made of a dielectric material such as polyethylene terephtharate. The presser member presses the belt against the photoconductive element at a position immediately preceding an image transfer position, thereby causing a paper sheet into close contact with the photoconductive element. Subsequently, as soon as the paper sheet moves away from the image transfer position, the presser member releases the belt from the photoconductive element. The presser member is associated with the transfer charger. The presser member is successful in urging the paper sheet against the photoconductive element by an adequate pressure. However, since this approach has no means for stabilizing electric fields between nearby image transfer positions, it is likely that undesired electric fields are developed in the vicinity of the belt to disturb the toner image. An extra function is available with the presser member, i.e., a function of preventing the charge developed the transfer charger from extending to the zone upstream of the image transfer position. Specifically, the presser member may be arranged such that the transfer charger does not act on the zone upstream of the position of the belt which the free end of the pressure member contacts. Nevertheless, the position where the free end of the presser member contacts the belt is not always the optimal boundary of the zone of interest. Moreover, since the free end of the presser member contacts the photoconductive element via the belt and paper sheet, a spatial discharge is apt to occur between the presser member and the photoconductive element due to the transfer charge sequentially accumulating on the member, especially when humidity is low. The spatial discharge would disturb the toner image carried on the photoconductive element and the toner image transferred to the paper sheet.

SUMMARY OF THE INVENTION

It is therefore an object of the present invention to provide an image transferring device for a color image recorder which desirably transfers toner images of different colors from photoconductive elements to a paper sheet or a belt, or intermediate transfer member, at successive image transfer positions, thereby preventing the resultant composite image on the paper sheet from being disturbed during transport.

It is another object of the present invention to provide an image transferring device for a color image recorder in which a member for pressing a belt against a photoconductive element and a member for limiting the range in which a transfer charge acts are implemented as a single member and, despite that a charge accumulates on the single member, a spatial discharge between the photoconductive element and the member is eliminated, thereby freeing a toner image transferred to a paper sheet from disturbance.

It is another object of the present invention to provide a generally improved image transferring device for a color image recorder.

In accordance with the present invention, a device incorporated in an image recorder for sequentially transferring images from a plurality of photoconductive elements to a recording medium one above another by transfer charges at successive image transfer positions has a belt made of a dielectric material and movable while sequentially contacting the photoconductive elements at the successive image transfer positions. A plurality of plates are located between nearby ones of the transfer positions in a range extending from the transfer position on the most upstream side with respect to the direction of movement of the belt to the transfer position on the most downstream side. The plates face each other with the intermediary of the belt and are fully spaced apart from opposite surfaces of the belt by a predetermined distance. The plates comprise a first and a second conductive member each having an insulating member on the surface thereof which faces the belt.

Also, in accordance with the present invention, a device incorporated in an image recorder for sequentially transferring images from a plurality of photoconductive elements to a recording medium one above another by transfer chargers at successive image transfer positions has a belt made of a dielectric material and movable while sequentially contacting the photoconductive elements at the successive image transfer positions. A first thin elastic member is made of a dielectric material and located in a position immediately preceding any one of the image transfer positions with respect to the direction of movement of the belt for urging the belt against associated one of the photoconductive elements with the free end thereof. A second thin elastic member is made of a dielectric material for preventing a charge from associated one of the transfer chargers from reaching a position upstream of the position immediately preceding the image transfer position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
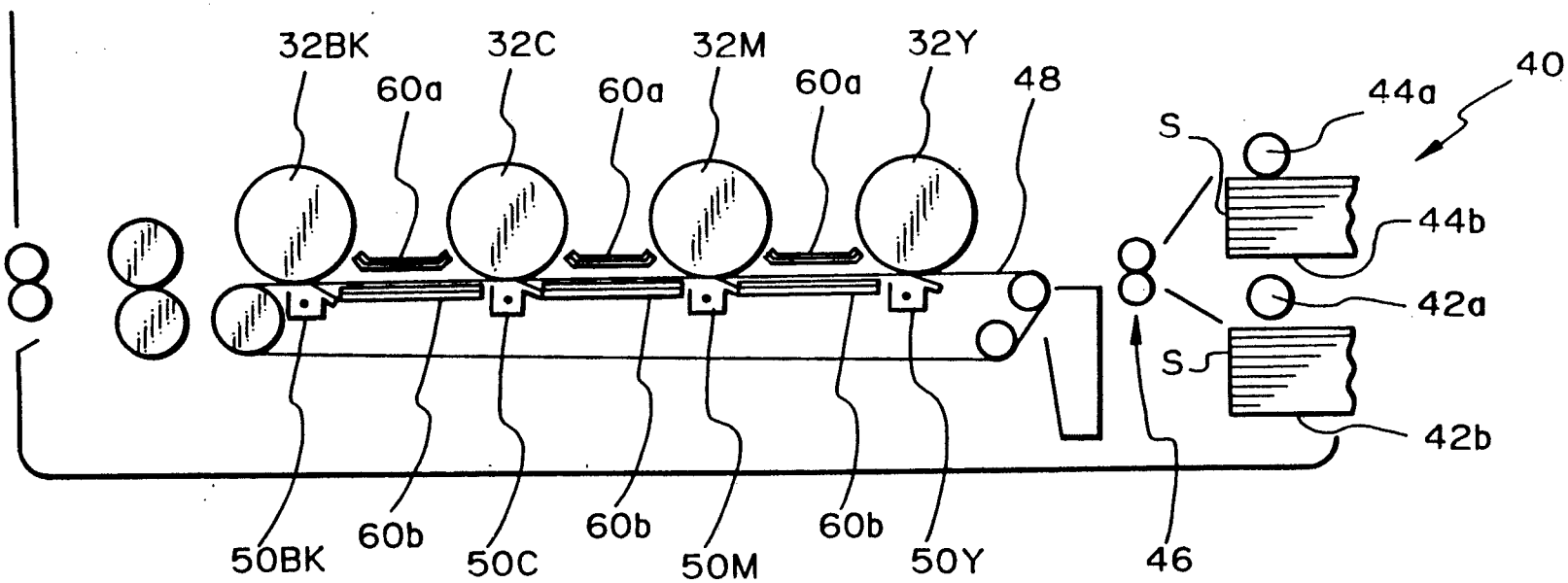
FIG. 1 is a section showing an image transferring device embodying the present invention.

To better understand the present invention, a reference will be made to a conventional electrophotographic full-color image recorder, shown in FIG. 6. As shown, the image recorder is implemented as a digital color copier 10 having an image reading section 100 and an image forming section 200. In the image recording section 100, lamps **16*a* and 16*b* illuminate a document 12 which is laid on a glass platen 14. The resultant reflection, or image light, from the document 12 is sequentially reflected by a first mirror 18, a second mirror 20 and a third mirror 22 which are movable. The image light from the third mirror 22 is propagated through a lens 24 to a dichroic prism 26 to be thereby separated into red (R), green (G) and blue (B) light components each having a particular wavelength. The light components R, G and B coming out of the dichroic prism 26 are incident to CCD arrays 28R, 28G and 28B, respectively. The CCD arrays 28R–28B each converts the input light component to a digital signal. A processor, not shown, processes the resulted digital signals and then feeds them to semiconductor lasers, not shown. Which are incorporated in the image forming section 200. Laser beams issuing from the lasers are reflected by associated polygonal mirrors 30Y, 30M, 30C and 30BK to be incident to photoconductive drums 32Y, 32M, 32C and 32Bk which are associated with the mirrors 30Y, 30M, 30C and 30BK, respectively. At this instant, the surfaces of the drums 32Y, 32M, 32C and 32BK have been uniformly charged by main chargers 34Y, 34M, and 34BK, respectively. As a result, a latent image representative of a particular color component is electrostatically formed on each of the drums 32Y–32BK. Developing units 36Y, 36M, 36C and 36BK store respectively a yellow toner 38Y, a magenta toner 38M, a cyan toner 38C and a black toner 38BK, and each develops associated one of the latent images by the toner stored therein. A recording medium in the form of a paper sheet S is fed from either one of paper cassettes 42*a* and 42*b* having feed rollers 44*a* and 44*b*, respectively. The paper sheet S fed out from the cassette 44*a* or 44*b* is driven to an endless belt 48 at a predetermined timing by a register roller pair 46. The belt 48 moves in a direction indicated by an arrow A in the figure. The belt 48** carrying the paper sheet S thereon sequentially transports the paper sheet S to successive image transfer positions defined below the drums 32Y-32BK. Transfer chargers 50Y, 50M, 50C and 50BK face respectively the drums 32Y-32Bk in the image transfer positions. The toner images of different colors are sequentially transferred from the drums 32Y-32BK to the paper sheet S one above another by transfer chargers 50Y-50BK. The resulted composite color image formed on the paper sheet S is fixed by a fixing roller pair 52. Finally, the paper sheet S with the fixed color image is driven out onto a tray, not shown. The transfer belt 48 is constituted by a film of polyester or similar dielectric substance and, therefore, charged by the transfer chargers 50Y-50BK. A discharger 54 is provided for dissipating the charge so deposited on the belt 48, i.e., initializing the belt 48. In another conventional system, the toner images of different colors are once transferred from the drums 32Y-32BK to the belt, or intermediate transfer member, 48 and then transferred from the belt 48 to the paper sheet S at a time.

As stated above, the belt 48 and transfer chargers 50Y-50BK incorporated in the color copier 10 constitute an image transferring device. The prerequisite with this kind of image transferring device is that the paper sheet S on the belt 48 closely contacts the surfaces of the drums 32Y-32BK. It has been customary, therefore, to use backup members which urge the belt 48 against the drums 32M-32Y from the rear of the belt 48. As shown in FIG. 6, the backup members are implemented as metallic rollers 56*a*, 56*b*, 56*c* to reduce the load acting on the belt 48 as far as possible. The rollers or backup rollers 56*a*-56*c* contact the rear of the upper run of the belt 48 and support the belt 48 while being rotated by the latter. However, the problem is that as the belt 48 made of a dielectric substance and charged by the transfer chargers 40Y-50BK are abruptly brought into and out of contact with the metallic rollers 56*a*-56*c*, undesired electric fields are developed therebetween. Such undesired electric fields disturb the desired electric fields developed between the transfer chargers 50Y-50BK and the drums 32Y-32BK. In addition, when the belt 48 leaves any one of the rollers 5*a*-56*c*, the potential between the belt 48 and the roller 56 rises to cause a separation discharge to occur with the result that the charge on the rear of the belt 48 is neutralized, loosing the force for retaining the toner. Consequently, the toner images to be transferred to the paper sheet S are disturbed.

Figure 7:
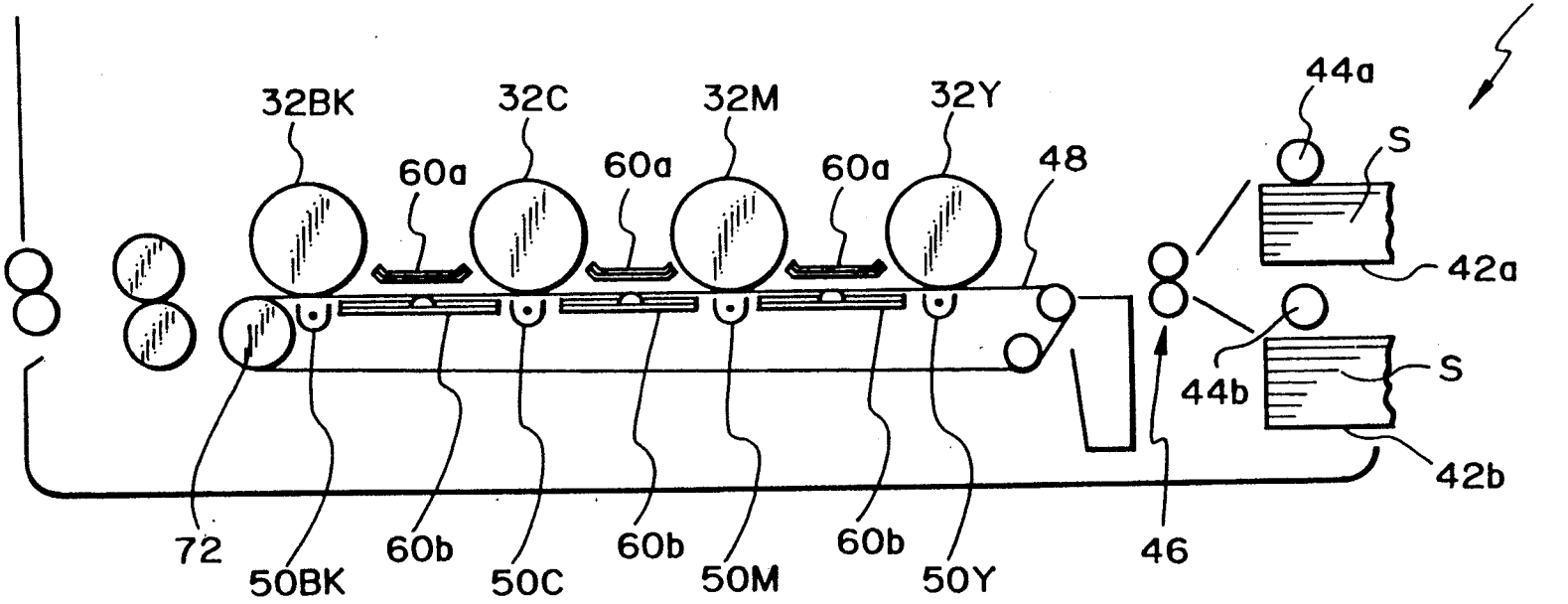
Fig. 7 PRIOR ART
FIG. 7 is a section showing a conventional image transferring device.
Figure 8:
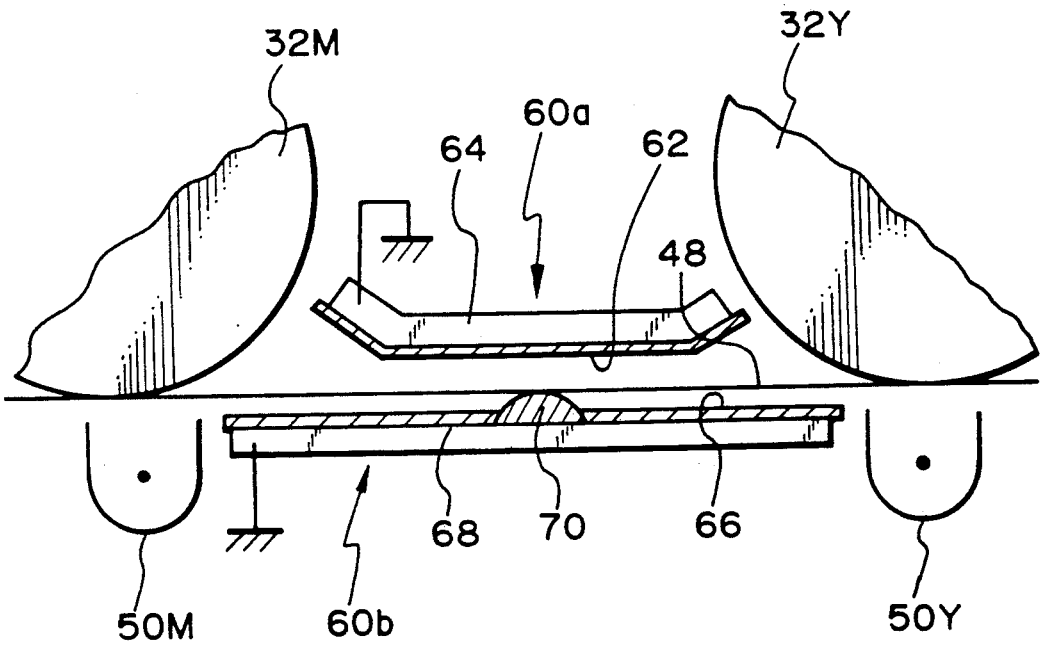
Fig. 8 PRIOR ART
FIG. 8 is a fragmentary enlarged section of the conventional image transferring device.

In light of the above, three pairs of field stabilizing plates may be arranged along opposite surfaces of the belt 48 at positions other than the positions where the drums 32Y-32BK face the associates transfer chargers 50Y-50BK with the intermediary of the belt 48, i.e., at positions between the nearby drums 32Y-32BK and between the nearby transfer chargers 50Y-50BK. Specifically, FIG. 7 shows a conventional image transferring device having such field stabilizing plate pairs, while FIG. 8 shows one of the field stabilizing plate pairs in an enlarged view. As shown, a first and a second field stabilizing plate 60*a* and 60*b* are provided in three pairs and face each other with the intermediary of the belt 48. The three field stabilizing plate pairs are arranged at spaced locations between the position immediately after the image transfer position on the most upstream side with respect to the moving direction A of the belt 48, i.e., the direction in which the paper sheet S is transported and the position where the paper sheet S leaves the belt 48. Such spaced locations are selected not to coincide with the image transfer positions where the drums 32Y-32BK and transfer chargers 50Y-50BK are located. The first field stabilizing plates 60*a* each is made up of an insulating member 62 having a surface that faces the front of the belt 48, and a metallic member or similar conductive member 64 connected to the rear of the insulating member 62. The metallic member 64 is connected to ground. The second field stabilizing plates 60*b* each has a backup member 66 made of an insulating material and having a surface that faces the rear of the belt 48, and a metallic member or similar dielectric member 68 connected to the rear of the backup member 66. The metallic member 68 is also connected to ground. As shown in FIG. 8, the backup member 66 of the second plate 60*b* has a lug 70 at the center thereof, i.e., the intermediate between the nearby transfer chargers 50Y and 50M. The lug 70 has a semiconductor section and abuts against the rear of the belt 48 at the top thereof to thereby support the belt 48.

In the above configuration, despite that the belt 48 is sequentially brought into and out of contact with the lugs 70 of the second field stabilizing plates 60*b*, the three field stabilizing plate pairs prevent the electric fields acting on the belt 48 from being disturbed. Especially, the second plates or backup plates 60*b* maintain the electric fields acting on the toner image carried on the paper sheet S being transported by the belt 48 extremely stable, compared to the metallic backup rollers 56*a*-56*c*, FIG. 6. Further, the potentials between the belt 48 and the first and second plates 60*a* and 60*b* undergo a minimum of rise, suppressing separation discharges. In the above-described conventional image transferring device, it often occurs that thin lines and the edges of solid images each having a substantial area, particularly the portions thereof where a great amount of toner deposits, are left blank inside. To eliminate this occurrence, a toner with an additive such as hydrophobic silica is sometimes used in order to enhance fluidity. In such a case, if the surfaces of the first and second plates 60*a* and 60*b* that face the belt 48 are constituted by metal in place of insulating material, the toner will be scattered around to deposit on the plates 60*a* and 60*b*. Then, the toner sequentially depositing and solidifying on the plats 60 and 60*b* will disturb the toner image carried on the paper sheet S being transported by the belt 48 by rubbing itself against the toner image. To overcome this problem, the first and second plates 60*a* and 60*b* each has an insulating member on the surface thereof which faces the belt 48, and the second plate 60*b* has an insulative lug 70 at the center of the backup member 66.

However, the conventional arrangement shown in FIGS. 7 and 8 bring about other problems, as follows. The corona discharge effected by the transfer chargers 50Y-50BK produce nitrogen oxides, while the belt 48 and a drive roller 72, FIG. 7, driving the belt 48 produce low-resistance impurities such as carbon of the drive roller 72 since they slide on each other. As such impurities deposit on the rear of the belt 48, i.e., between the belt 48 and the backup lugs 70, the electric fields fluctuate in the vicinity of the belt 48 to cause discharges to occur, disturbing the toner image. Furthermore, when the belt 48 is supported by the backup lugs 70, the presence urging the belt 48, i.e., the paper sheet S against any one of the drums 32Y-32BK is not always optimal and is susceptible to ambient conditions. If this pressure is low, the toner image will not be satisfactory transferred from the drum 32 to the paper sheet S and, therefore, the image density on the paper sheet S will be low. Conversely, excessively high pressures would result in defective image transfer such as the previously stated local omission of images. While use may be made of a toner with an additive which enhances fluidity, as stated earlier, the amount of additive should be limited in consideration of the filming to occur on the drums and the change in ambient conditions.

Figure 9:
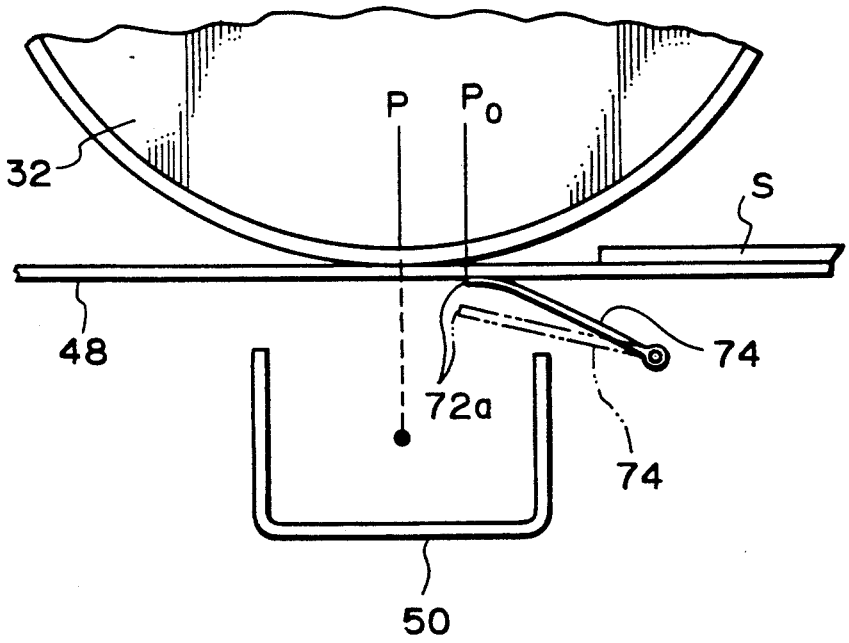
Fig. 9 PRIOR ART
FIG. 9 is a section showing another conventional image transferring device.

FIG. 9 shows a conventional approach to urge the paper sheet S against the drums 32Y-32BK by an adequate pressure, as disclosed in Japanese Patent Laid-Open Publication No. 127770/1987 by way of example. As shown, a presser member 74 is implemented as a thin elastic plate made of a dielectric material such as polyethylene terephtharate. The pressure member 74 presses the belt 48 against the drum 32 at a position $P_0$ immediately preceding an image transfer position P, thereby causing the paper sheet S into close contact with the drum 32. Subsequently, as soon as the paper sheet S moves away from the position P, the presser member 74 releases the belt 48 from the drum 32. The presser member 74 is associated with the transfer charger 50. The presser member 74 is successful in urging the paper sheet S against the drum 32 by an adequate pressure. However, since this approach has no means for stabilizing electric fields between nearby image transfer positions P, it is likely that undesired electric fields are developed in the vicinity of the belt 48 to disturb the toner image. An extra function is available with the presser member 74, i.e., a function of preventing the charge from the transfer charger 50 from extending to the zone upstream of the image transfer position P. Specifically, the presser member 74 may be arranged such that the transfer charge does not act on the zone upstream of the position of the belt 48 which the free end 72*a* of the pressure member 74 contacts, i.e., the position $P_0$. Nevertheless, the position $P_0$ is not always the optimal boundary of the zone of interest. Moreover, since the free end 72*a* of the presser member 74 contacts the drum 32 via the belt 48 and paper sheet S, a spatial discharge is apt to occur between the presser member 74 and the drum 32 due to the transfer charge sequentially accumulating on the member 74, especially when humidity is low. The spatial discharge would disturb the toner image carried on the drum 32 and the toner image transferred to the paper sheet 32.

Preferred embodiments of the present invention free from the above-discussed problems will be described with reference to FIGS. 1 through 5. In these figures, the parts and elements functionally equivalent to the those of the conventional device are designated by the same reference numerals, and redundant description will be avoided for simplicity.

Figure 2:
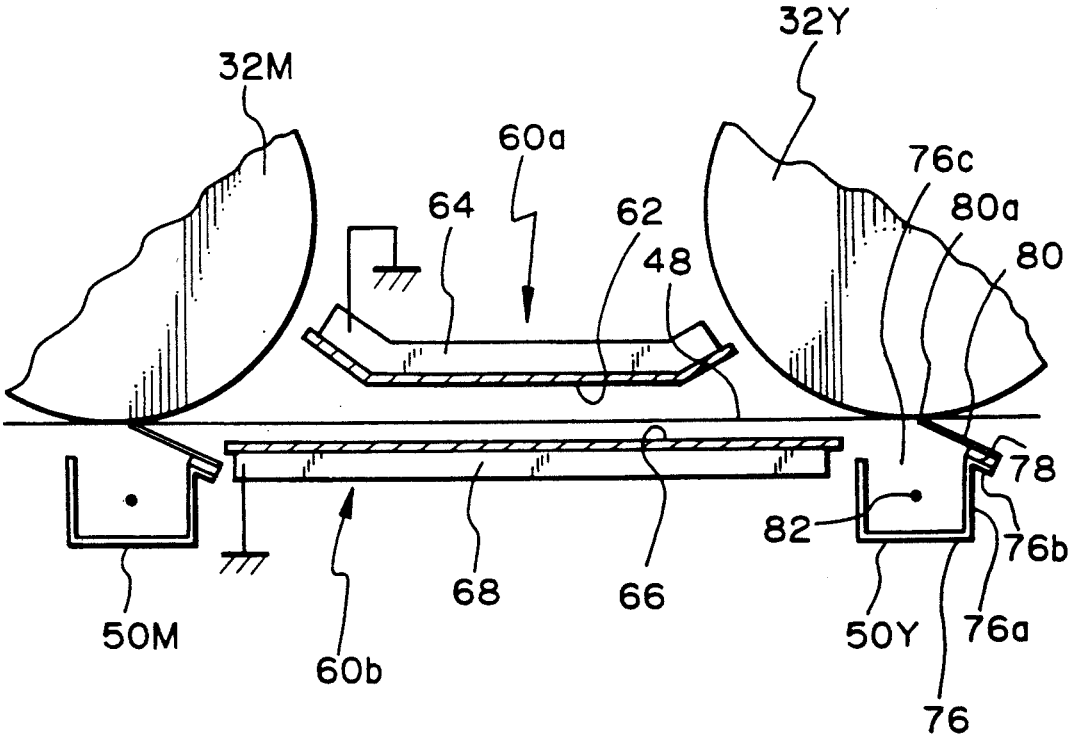
FIG. 2 is a fragmentary enlarged section of the embodiment.
Figure 6:
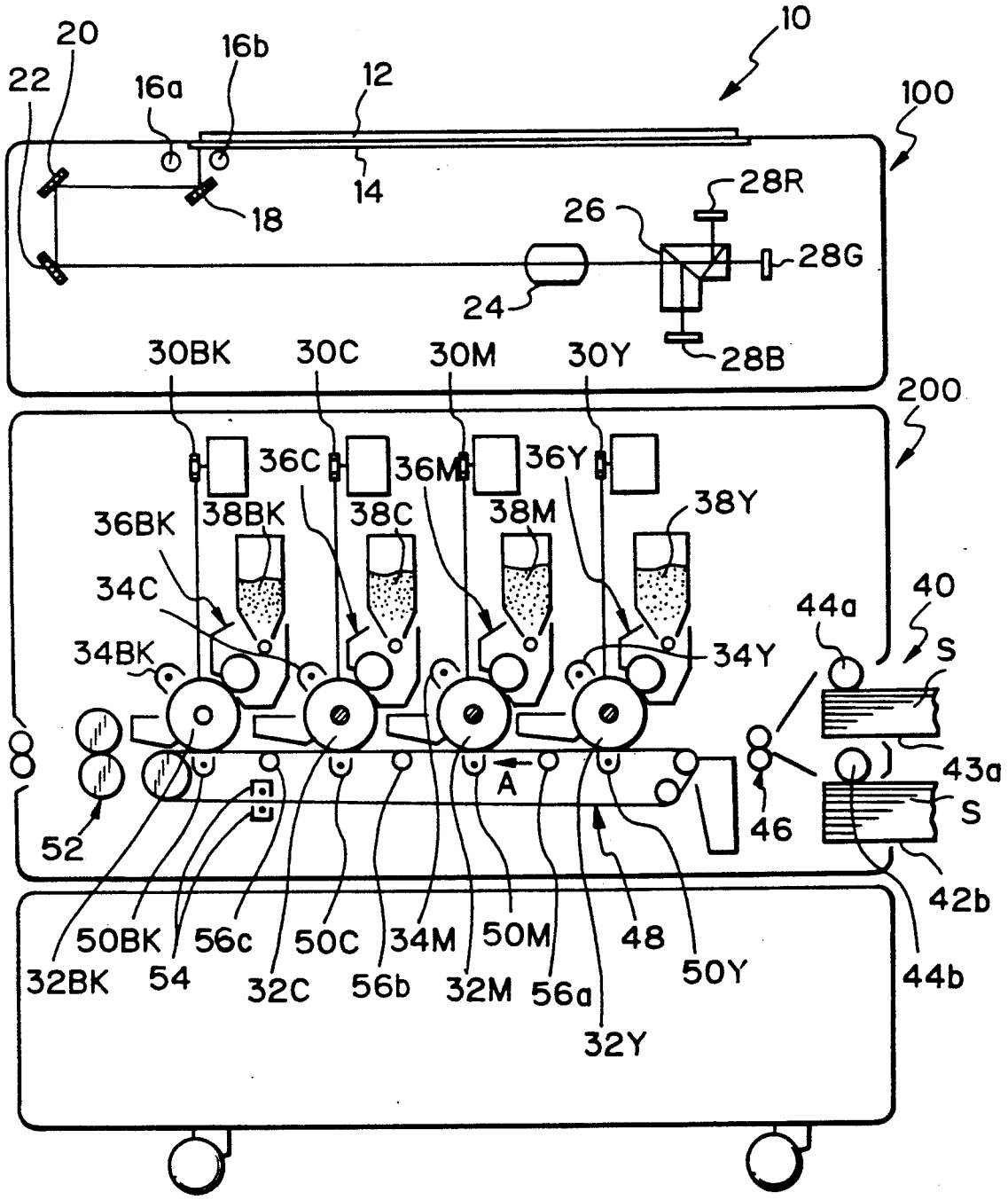
Fig. 6 PRIOR ART
FIG. 6 is a section showing a specific construction of a color image recorder to which the embodiments of the present invention are applicable.

Referring to FIGS. 1 and 2, an image transferring device embodying the present invention is shown which is applied to the color copier 10 shown in FIG. 6. As shown, the image transferring device has a first and a second field stabilizing plate 60*a* and 60*b* in three pairs which are substantially identical in configuration with the plates 60*a* and 60*b* shown in FIGS. 7 and 8. The difference is that in the embodiment an insulative backup member 66 provided on the second field stabilizing plate 60*b* does not have the backup lug 70 for supporting the belt 48. Hence, both of the first and second field stabilizing plates 60*a* and 60*b* are fully spaced apart from the belt 48. As shown in FIG. 2, transfer chargers 50Y-50BK each has a shield case 76 which is provided with a flange 76*b* at the top of one side wall 76*a* located at the upstream side with respect to the direction for transporting a paper sheet S. An elastic thin plate 80 made of polyethylene terephtharate or similar insulating material is mounted on the flange 76*b* such that the free end 80*a* thereof presses the belt 48 against a drum 32 at a position immediately preceding an image transfer position. The elastic plate 80 covers part of the opening 76*c* of the shield case 76 and, in this particular part, plays the role of a transfer charge limiting member which prevents the charge developed by a charge wire 82 from reaching the belt 48.

In the above construction, the elastic plates 80 each presses the belt 48 against one of the drums 32Y-32BK surely by a predetermined pressure at the associated image transfer position. At the same time, the elastic plates 80 limits the transfer charges developed by the associated transfer chargers 50Y-50BK. As a result, toner images formed on the drums 32Y-32BK are transferred to the belt 48 or the paper sheet S carried thereon by predetermined transfer charges. Moreover, the belt 48 is spaced apart from both of the first and second field stabilizing plates 60*a* and 60*b* by a predetermined distance. Such a configuration protects the electric fields against fluctuation in the vicinity of the belt 48 and thereby prevents the toner image carried on the belt 48 or on the paper sheet S from being disturbed. In addition, even when use is made of a toner with an additive as previously stated, the embodiment prevents the toner from being scattered and, therefore, from lowering the resolution or rubbing an image.

Figure 3:
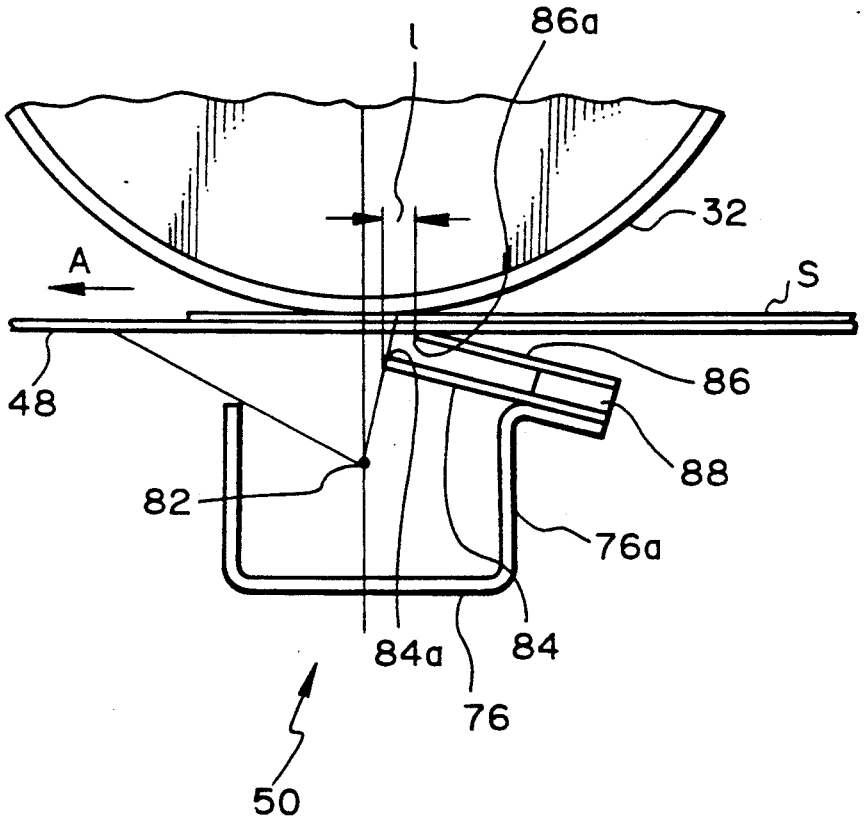
FIG. 3 is a fragmentary section showing an alternative embodiment of the present invention.

Referring to FIG. 3, an alternative embodiment of the present invention is shown which is also applied to the color copier 10 shown in FIG. 6. As shown, the wall 76*a* of the shield case 76 of the transfer charger 50 is bent outward and obliquely downward at the upper end 76*b* thereof. A transfer charge limiting member 84 and an elastic presser member 86 are mounted on the bent end 76*b* of the side wall 76*a*. The two members 84 and 86 each is implemented as an elastic thin plate made of polyethylene terephtharate or similar dielectric material. The members 84 and 86 are spaced apart from each other by a spacer 88 and extend obliquely upward toward the center of the transfer charger 50 in parallel with each other. The presser member 86 urges the belt 48 against the drum 32 with the free end 86*a* thereof. The free end 84*a* of the transfer charge limiting member 84 is spaced apart from the underside of the belt 48 and protrudes beyond the free end 86*a* of the presser member 86 by a distance l in the direction in which the belt 48 moves. In this construction, the corona charge from the charge wire 82 of the transfer charger 50 is limited by the limiting member 84. Specifically, the charge deposits on the limiting member 84 at the upstream side with respect to the free end 84*a* of the member 84 and reaches the belt 48 at the downstream side. The free end 86*a* of the presser member 86 is located at the rear or upstream side of the free end 84*a* of the limiting member 86 by the distance l. This, coupled with the fact that the pressure member 86 is spaced apart from the limiting member 84 by the spacer 88, prevents the member 86 from interfering with the operation of the member 84 and prevents the charge from depositing on the member 86. Hence, although the charge deposits on the limiting member 84, a spatial discharge rarely occurs between the member 84 and the drum 32. This is successful in freeing images from disturbance due to discharges which are apt to occur when the humidity is low.

Figure 4:
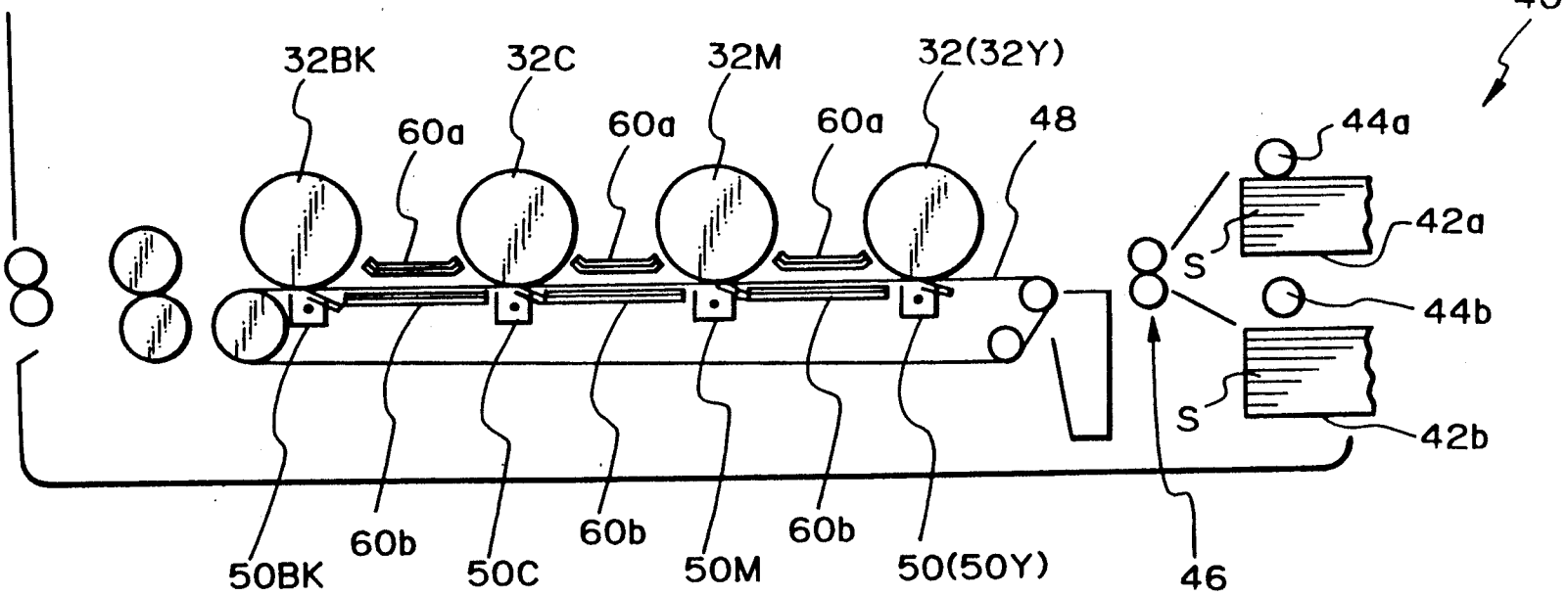
FIG. 4 is a section showing a modification of the embodiment of FIG. 3.
Figure 5:
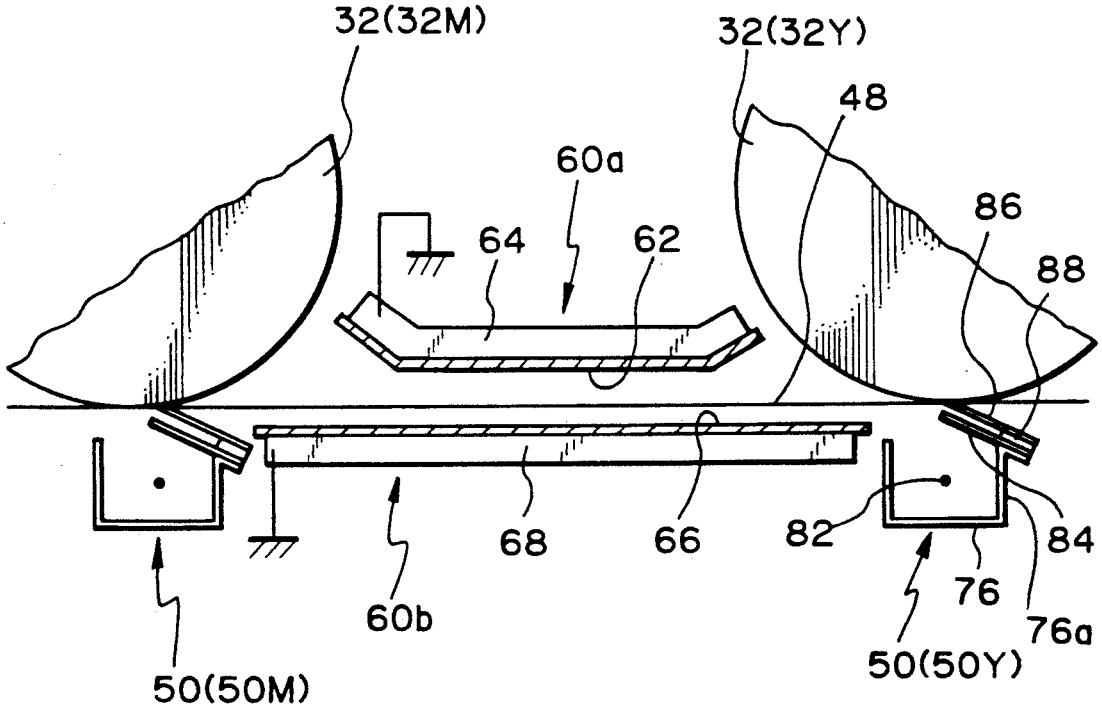
FIG. 5 is a fragmentary enlarged section of the arrangement shown in FIG. 4.

As shown in FIGS. 4 and 5, the first and second field stabilizing plates 60*a* and 60*b* may also be incorporated in the embodiment of FIG. 3 in order to stabilize the electric fields in the vicinity of the belt 48.

In summary it will be seen that the present invention provides an image transferring device which surely and desirably transfers toner images to a transfer belt or a paper sheet and prevents the toner images from being disturbed during transport. Even when use is made of a toner with an additive which enhances fluidity, the device of the present invention frees the toner images from rubbing and thereby insures high quality images. A member for urging the belt against a photoconductive element plays the role of a transfer charge limiting member at the same time, reducing the number of parts and thereby cutting the same time, reducing the number of parts and thereby cutting down the cost.

Further, despite that charges deposit on the transfer charge limiting member, a spatial discharge rarely occurs between it and the photoconductive element. A first and a second field stabilizing plate are located between nearby image transfer positions to face opposite sides of the belt. These plates eliminate the disturbance to images which is apt to occur when the humidity is low, thereby further enhancing the quality of images.

Various modifications will become possible for those skilled in the art after receiving the teachings of the present disclosure without departing from the scope thereof.

What is claimed is:

1. A device incorporated in an image recorder for sequentially transferring images from a plurality of photoconductive elements to a recording medium in such a way that the images are superposed on each other one by one by transfer chargers at successive image transfer positions, said device comprising:

a belt made of a dielectric material and movable while sequentially contacting said photoconductive elements at said successive image transfer positions; and a plurality of plate means located between nearby ones of said transfer positions in a range extending from the transfer position on the most upstream side with respect to a direction of movement of said belt to the transfer position on the most downstream side, said plurality of plate means facing each other with the intermediary of said belt and being fully spaced apart from opposite surfaces of said belt by a predetermined distance;

wherein said plurality of plate means comprises a first and a second conductive member each having an insulating member on a surface thereof which faces said belt, and said belt pressing means and said transfer charge restricting means comprise a single bifunctioning member implemented as a thin insulating member which covers part of an opening of a shield case of associated one of said transfer chargers and contacts said belt at the free end thereof.

2. A device incorporated in an image recorded for sequentially transferring images from a plurality of photoconductive elements to a recording medium in such a way that the images are superposed on each other one by one by transfer chargers at successive image transfer positions, said device comprising:

a belt made of a dielectric material and movable while sequentially contracting said photoconductive elements at said successive image transfer positions; and a plurality of plate means located between nearby ones of said transfer positions in a range extending from the transfer position on the most upstream side with respect to a direction of movement of said belt to the transfer position on the most downstream side, said plurality of plate means facing each other with the intermediary of said belt and being fully spaced apart from opposite surfaces of said belt by a predetermined distance;

wherein said plurality means comprises a first and a second conductive member each having an insulting member on a surface thereof which faces said belt, and said belt pressing member comprises a first thin elastic member made of a dielectric material and contacting said belt at the free end thereof, while said transfer charge limiting means comprises a second thin elastic member made of a dielectric material and substantially parallel to and spaced apart from said first thin elastic member by a predetermined distance while covering part of an opening of a shield case of associated one of said transfer chargers.

3. A device as claimed in claim 2, wherein the free end of said second thin elastic member is positioned downstream of the free end of said first thin elastic member in said direction of movement of said belt.

4. A device incorporated in an image recorder for sequentially transferring images from a plurality of photoconductive elements to a recording medium in such a way that the images are superposed on each other one by one by transfer charges at successive image transfer positions, said device comprising:

a belt made of a dielectric material and movable while sequentially contacting said photoconductive elements at said successive image transfer positions;

a first thin elastic member made of a dielectric material and located in a position immediately preceding any one of said image transfer positions with respect to a direction of movement of said belt for urging said belt against associated one said photoconductive elements with the free end thereof; and a second thin elastic member located below said first thin elastic member and made of a dielectric material for preventing a charge from associated one of said transfer chargers from reaching a position upstream of said position immediately preceding said image transfer position.

5. A device as claimed in claim 4, wherein said first and second thin elastic members are parallel and spaced apart from each other by a predetermined distance, the free end of said second thin elastic member being positioned downstream of the free end of said thin elastic member with respect to said direction of movement of said belt.

6. A device incorporated in the image recorder for sequentially transferring images from a plurality of photoconductive elements to a recording medium in such a way that the images are superposed on each other one by one by transfer chargers at successive image transfer positions, said device comprising:

a belt made of a dielectric material and movable while sequentially contacting said photoconductive elements at said successive image transfer positions; and a plurality of plate means located between nearby ones of said transfer positions in a range extending from the transfer position on the most upstream side with respect to a direction of movement of said belt to the transfer position on the most downstream side, said plurality of plate means facing each other with the intermediary of said belt and being fully spaced apart from opposite surfaces of said belt by a predetermined distance;

wherein said plurality of plate means comprises a first and a second conductive member each having an insulating member on a surface thereof which faces said belt;

said device further comprising:

belt pressing means for pressing said belt against said photoconductive elements at positions each immediately preceding respective one of said image transfer positions; and transfer charge limiting means for limiting a charge from any one of said transfer charges such that said charge does not reach a zone upstream of associated one of said positions immediately preceding said image transfer positions.

7. A device incorporated in an image recorder for sequentially transferring images from a plurality of photoconductive elements to a recording medium in such a way that the images are superposed on each other one by one by transfer charges at successive image transfer positions, said device comprising:

a belt made of a dielectric material and movable while sequentially contacting said photoconductive element at said successive image transfer positions;

a plurality of plate means located between nearby ones of said transfer positions in a range extending from the transfer position on the most upstream side with respect to a direction of movement of said belt to the transfer position on the most downstream side, said plurality of plate means facing each other with the intermediary of said belt and being fully spaced apart from opposite surfaces of said belt by a predetermined distance; and belt pressing means for pressing said belt against said photoconductive elements at positions each immediately preceding respective one of said image transfer positions;

wherein said plurality of plate means comprise a first and a second conductive member each having an insulating member on a surface thereof which faces said belt.

* * * * *

UNITED STATES PATENT AND TRADEMARK OFFICE

CERTIFICATE OF CORRECTION

PATENT NO. : 5,189,479

DATED : FEBRUARY 23, 1993

INVENTOR(S) : MATSUDA et al.

It is certified that error appears in the above-indentified patent and that said Letters Patent is hereby corrected as shown below:

In column 1, line 59, change "loosing" to --losing--.

In column 1, line 68, change "photoinductive" to --photoconductive--.

In column 2, line 35, change "using" to --urging--.

In column 4, lines 45/46, change "shown. Which" to --shown, which--.

In column 5, line 46, change "loosing" to --losing--.

In column 6, line 8, change "to ground." to --to the ground.--

In column 6, line 14, change "ground." to --the ground.--

In column 6, line 17, change "semiconductor" to --semicircular"--.

In column 6, line 44, change "plats 60" to --plates 60a--.

UNITED STATES PATENT AND TRADEMARK OFFICE

CERTIFICATE OF CORRECTION

PATENT NO. : 5,189,479

DATED : FEBRUARY 23, 1993

INVENTOR(S) : MATSUDA et al.

It is certified that error appears in the above-indentified patent and that said Letters Patent is hereby corrected as shown below:

In column 6, line 64, change "presence" to --pressure--.

In column 6, line 68, change "satisfactory" to --satisfactorily--.

In column 7, lines 51/52 change "equivalent to the those" to --equivalent to those--.

In column 8, line 17, change "limits" to --limit--.

In column 10, line 10, change "plurality means" to --plurality of plate means--.

In column 10, line 52, change "said thin" to --said first thin--.

Signed and Sealed this

Third Day of March, 1998

*Attest:*

*Attesting Officer*

BRUCE LEHMAN

*Commissioner of Patents and Trademarks*